US008042621B2

(12) United States Patent
Barezzani et al.

(10) Patent No.: US 8,042,621 B2
(45) Date of Patent: Oct. 25, 2011

(54) IMPACT MECHANISM FOR AN IMPACT WRENCH

(75) Inventors: Gualtiero Barezzani, Concesio (IT); Gianpaolo Luciani, Brescia (IT); Gianfranco Musoni, Brescia (IT)

(73) Assignee: Cembre S.p.A., Brescia (IT)

( * ) Notice: Subject to any disclaimer, the term of this patent is extended or adjusted under 35 U.S.C. 154(b) by 241 days.

(21) Appl. No.: 11/886,632

(22) PCT Filed: Apr. 13, 2005

(86) PCT No.: PCT/IT2005/000210

§ 371 (c)(1), (2), (4) Date: Sep. 18, 2007

(87) PCT Pub. No.: WO2006/109332

PCT Pub. Date: Oct. 19, 2006

(65) Prior Publication Data

US 2009/0014193 A1 Jan. 15, 2009

(51) Int. Cl.
*B25D 15/00* (2006.01)

(52) U.S. Cl. ..... 173/93; 173/93.5; 173/93.6

(58) Field of Classification Search ..... 173/93, 173/93.5, 93.6; 81/467

See application file for complete search history.

(56) References Cited

U.S. PATENT DOCUMENTS

| | | | | |
|---|---|---|---|---|
| 2,691,434 A | | 10/1954 | Jimerson | |
| 2,712,254 A | * | 7/1955 | Schodeberg | 173/93.6 |
| 2,756,853 A | * | 7/1956 | Madsen | 173/93.6 |
| 2,821,276 A | | 1/1958 | Reynolds | |
| 2,940,565 A | * | 6/1960 | Schodeberg | 173/93.6 |
| 3,009,552 A | | 11/1961 | Ondeck | |
| 3,068,973 A | | 12/1962 | Maurer | |
| 4,232,750 A | * | 11/1980 | Antipov et al. | 173/93.6 |
| 4,243,108 A | * | 1/1981 | Galimov et al. | 173/93 |
| 4,350,213 A | * | 9/1982 | Antipov et al. | 173/93.6 |
| 5,836,403 A | * | 11/1998 | Putney et al. | 173/205 |
| 5,992,538 A | | 11/1999 | Marcengill et al. | |
| 6,223,834 B1 | | 5/2001 | Takamura et al. | |
| 6,457,535 B1 | * | 10/2002 | Tanaka | 173/48 |
| 6,733,414 B2 | * | 5/2004 | Elger | 475/331 |
| 7,086,483 B2 | * | 8/2006 | Arimura et al. | 173/217 |

FOREIGN PATENT DOCUMENTS

| | | |
|---|---|---|
| DE | 1 274 048 | 7/1968 |
| EP | 0 839 612 | 5/1998 |
| GB | 851370 | 10/1960 |
| GB | 1184892 | 3/1970 |
| JP | 2001-501877 T | 2/2001 |
| WO | WO 99/07521 A1 | 2/1999 |

* cited by examiner

*Primary Examiner* — Rinaldi Rada
*Assistant Examiner* — Nathaniel Chukwurah
(74) *Attorney, Agent, or Firm* — Dickstein Shapiro LLP

(57) ABSTRACT

An impact mechanism (12) for an impact wrench comprises an anvil (8) with a middle portion (13), at least one abutment surface (14) radially protruding therefrom, which forms at least one abutment surface (15), a hammer (4) with an impact surface (16) suitable to give rotational pulses to the anvil (8) by the impact surface (16) hitting the abutment surface (15). The anvil (8) comprises a first connection area (17) connecting the abutment portion (14) to the middle portion (13) within the axial extension of the abutment surface (15) and the middle portion (13) and a reinforcement rib (18) axially arranged out of the abutment surfaces (15) that connects the abutment portion (14) to the middle portion (13) of the anvil (8), thereby forming a second connecting area.

39 Claims, 4 Drawing Sheets

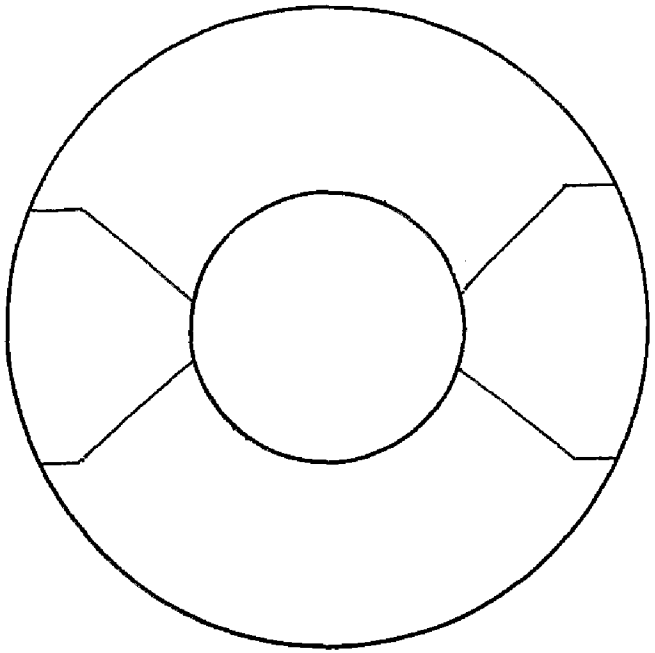
PRIOR ART FIG. 2
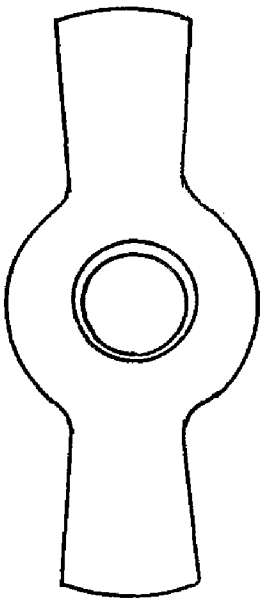
PRIOR ART FIG. 1

IMPACT MECHANISM FOR AN IMPACT WRENCH

The object of the present invention is an impact mechanism for an impact wrench and an impact wrench provided with said impact mechanism.

Impact wrenchs are usually used to tighten or loosen threaded clamping elements, such as bolts, nuts and screws.

The prior art impact wrenchs typically comprise an output shaft, which is rotatably supported about a rotation axis, with a first tool-holding end for connecting a tool engaging and rotating the clamping element and a second end connected to an anvil which is suitable to integrally rotatably engage a hammer, as well as receive rotational blows therefrom.

The hammer can be operated to rotate about the rotation axis and is suitable to engage the anvil and strike said blows on the anvil such that the anvil and output shaft assembly is caused to rotate about the rotation axis.

Drive means, for example a spark-ignition or electric engine interacting with a reduction mechanism are provided to produce a rotational motion and a corresponding torque to rotate the hammer. The drive means are connected to the hammer by a disengaging mechanism being interposed therebetween that, when a maximum resisting moment is exceeded, is suitable to temporarily disengage the hammer from the anvil, by moving them away from each other, so that the hammer can be rotated and accelerated by the drive means in order to accumulate the moment of the amount of rotary motion required for a subsequent rotational blow against the anvil.

The drive means and the impact mechanism are usually suitable to rotate the output shaft in both directions such that the threaded clamping elements can be either tightened or loosened.

The screwing torque that can be actually applied on the clamping element depends on the one hand on the dimensioning of the drive means, i.e. the engine power, and on the other hand, on the efficacy of the torque transmission from the engine to the output shaft.

When the maximum resisting moment is exceeded and the disengaging mechanism starts the pulsed operation, the efficacy of torque transmission to the output shaft depends on the efficacy of the hammer in giving torsional pulses to the anvil.

Several applications of the impact wrenchs, such as tightening and loosening the clamping screws used for the laying, replacement or maintenance of railways can require very high torsional torques and pulses.

In order to obtain high screwing torques and torsional pulses, it is necessary to have an engine with a sufficiently high power on the one hand, and an impact mechanism suitable to produce this high torque by means of torsional blows on the other hand.

Furthermore, there are design restrictions difficult to match, particularly in the railway field, which require high screwing torque, small size, and durability of the equipment in terms of screwing and unscrewing cycles.

As a result of the experiences in recent decades and continuous effort to match said design restrictions, only one impact mechanism solution is currently considered as satisfying and, therefore, this is used worldwide in the most demanding applications in the railway field.

This known solution provides an anvil having a middle portion with two arms of constant width protruding therefrom. Each arm has two opposite abutment surfaces, which are suitable to receive, from a hammer, the blows through which the screwing or unscrewing torque is transmitted. To avoid that the anvil may prematurely break in the transition area between the arms and the middle portion, it has always been attempted to obtain a high section area in this area of the arms and reduce the radial extension of the arms, in order to reduce both the absolute value of the stresses and the bending moment in this transition or connection area between the arms and the middle portion. The result of these past experiences is the known anvil shape, such as illustrated in FIG. 1.

Consequently to the shape of the anvil, the known hammer (FIG. 2) has two impact portions axially protruding from a cylindrical body. The two impact portions are arranged in a radially opposed manner and have a radial distance corresponding to that between the two anvil arms.

Each impact portion forms two impact surfaces lying on planes parallel to the rotation axis of the impact mechanism and away from this rotation axis by about half the width of the anvil arms.

At the same mass and life, the known impact mechanism allows to transmit a certain maximum value of rotary moment or pulse by means of blows.

This threshold value, however, is not sufficient for certain works, such as unscrewing rusty bolts in railway joints.

With the known impact mechanisms, an increase in the screwing torque, such as by using a more powerful engine, implies the occurrence of fatigue breaking (both in the hammer and the anvil) which shortens the impact wrench life. The only way that is currently known to increase the life of the impact wrench is to over-dimension the whole impact mechanism.

However, such an over-dimensioning would result in a weight increase that would make the impact wrench very uncomfortable to use by hand. Furthermore, a further enlargement of the impact mechanism would entail an excessive, and hence undesired, increase in the rotational inertia of the hammer and anvil, which is difficult to control for example in terms of vibrations.

Therefore, the object of the present invention is to provide an impact mechanism for an impact wrench having such characteristics as to generate a greater screwing torque at the same weight and life.

This and other objects are achieved by means of an impact mechanism comprising

- an anvil rotating about a rotation axis and provided with a middle portion from which there radially projects at least one abutment portion forming at least one abutment surface,
- a hammer rotating about the rotation axis and provided with at least one impact surface, wherein the hammer is suitable to give rotational pulses to the anvil by the impact surface hitting the abutment surface, wherein the anvil comprises a first connection area connecting the abutment portion and the middle portion, said first connection area extending within the axial extension of the abutment surface and the middle portion wherein the anvil comprises a reinforcement rib being axially arranged out of the abutment surfaces which connects the abutment portions to the middle portion of the anvil, thereby forming a second connection area.

In order to better understand the invention and appreciate the advantages thereof, some exemplary non-limiting embodiments of the same are described herein below, with reference to the annexed drawings, in which:

FIG. 1 is a front view of an impact mechanism anvil according to the prior art;

FIG. 2 is a front view of an impact mechanism hammer according to the prior art;

Figure 3:
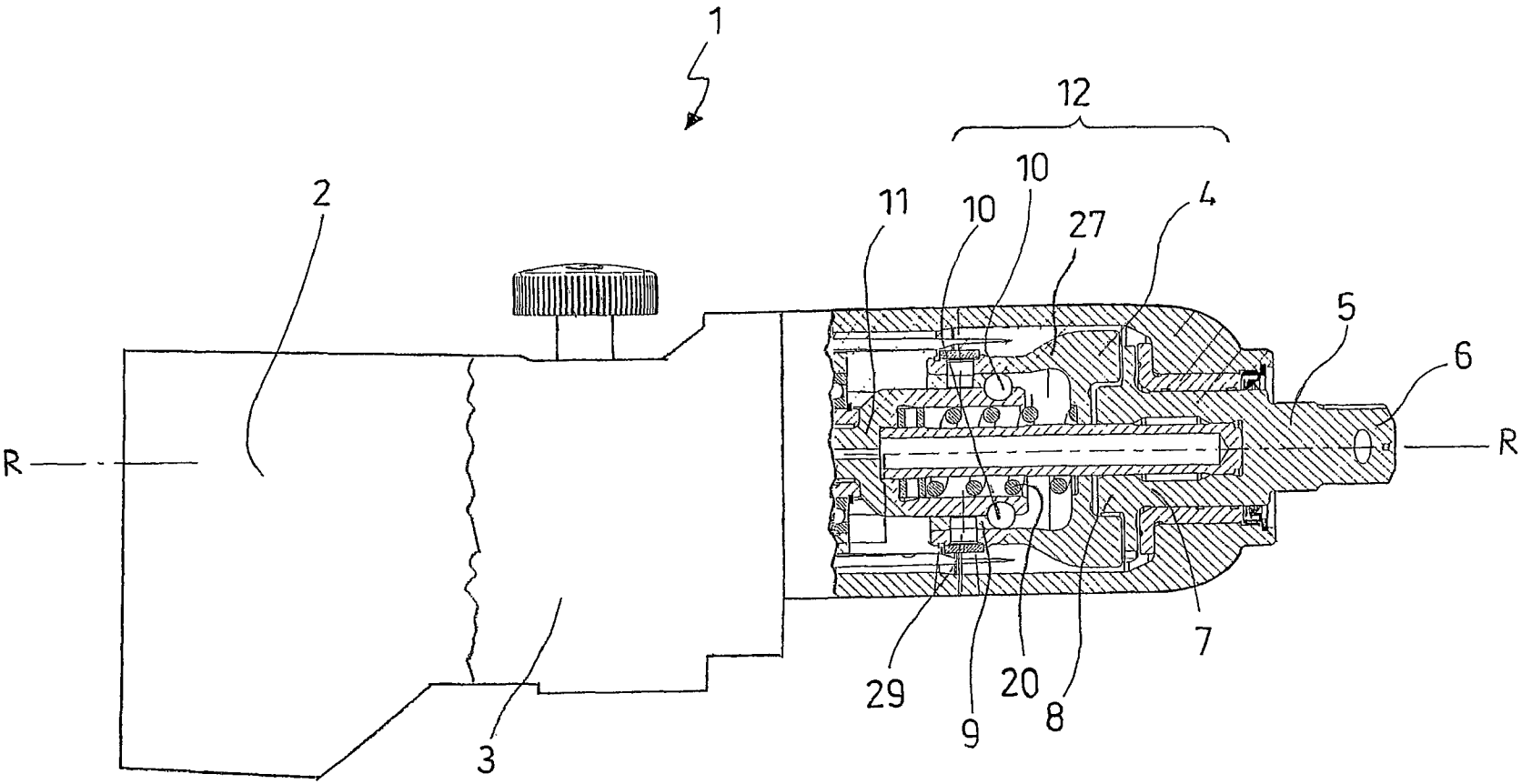
FIG. 3 is a partial sectional view of an impact wrench provided with an impact mechanism according to an embodiment of the invention.

With reference to FIG. 3, an impact wrench is generally indicated with numeral 1. The impact wrench 1 comprises drive means, such as a spark-ignition 2, electric or pneumatic motor, interacting with a reduction mechanism 3 such as to produce a rotary motion and a corresponding torque to rotate a hammer 4 about a rotation axis R.

An output shaft 5 pivotally supported about the rotation axis R comprises a first tool-holding end 6 for a tool engaging and rotating a clamping element, such as a screw or nut, to be connected thereto, and a second end 7 that can be connected or is integrally connected to an anvil 8. The hammer 4 is suitable to engage the anvil 8 and strike rotational blows to the anvil 8 such as to rotate the anvil 8 and output shaft 5 assembly about the rotation axis R.

To the purpose, the drive means are coupled with the hammer 4 by interposing a disengaging mechanism, such as a cam track 9 in association with the hammer 4, which interacts with at least one revolving element, preferably with two balls 10 that are associated with a drive shaft 11 of the reduction mechanism 3. The disengaging mechanism is suitable to move the hammer 4 away from the anvil 8, thus disengaging them temporarily from each other, such that the hammer 4 can be rotated and accelerated by the drive means to accumulate a moment of the amount of rotary motion required for a rotational blow against the anvil 8.

The disengaging mechanism then starts a percussion operation when an ultimate resistant moment is exceeded, which can be set and adjusted by means of the rigidity and degree of pre-compression of a helical spring 20 that provides a defined contact force between the balls 10 and the cam track 9.

Advantageously, the drive means and the impact mechanism 12, i.e. the hammer 4 and anvil 8 assembly, are suitable to rotate the output shaft 5 in both directions for the clamping elements to be either tightened or loosened.

Figure 5:
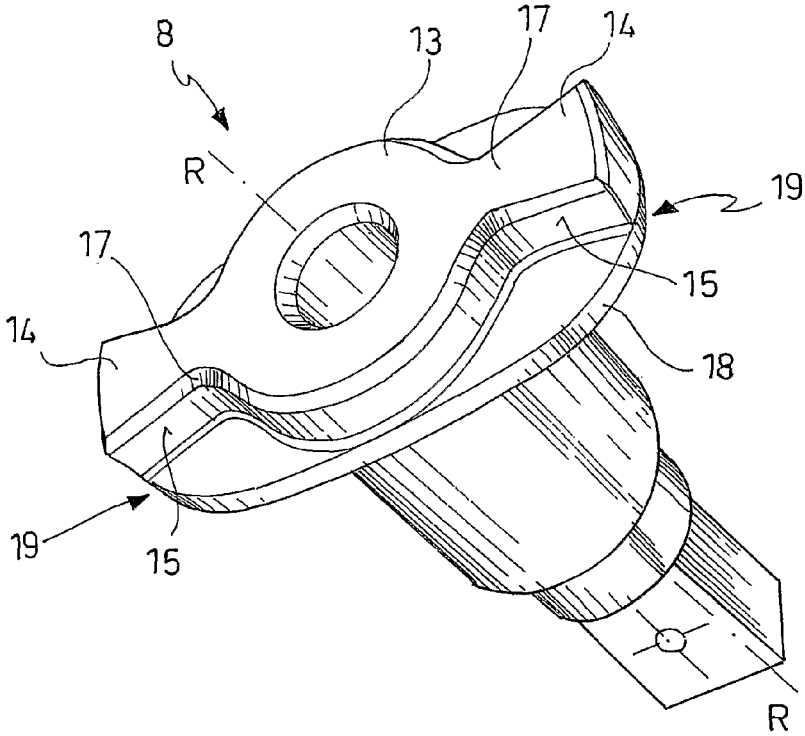
FIG. 5 is a perspective view of an anvil of the impact mechanism according to an embodiment of the invention.
Figure 4:
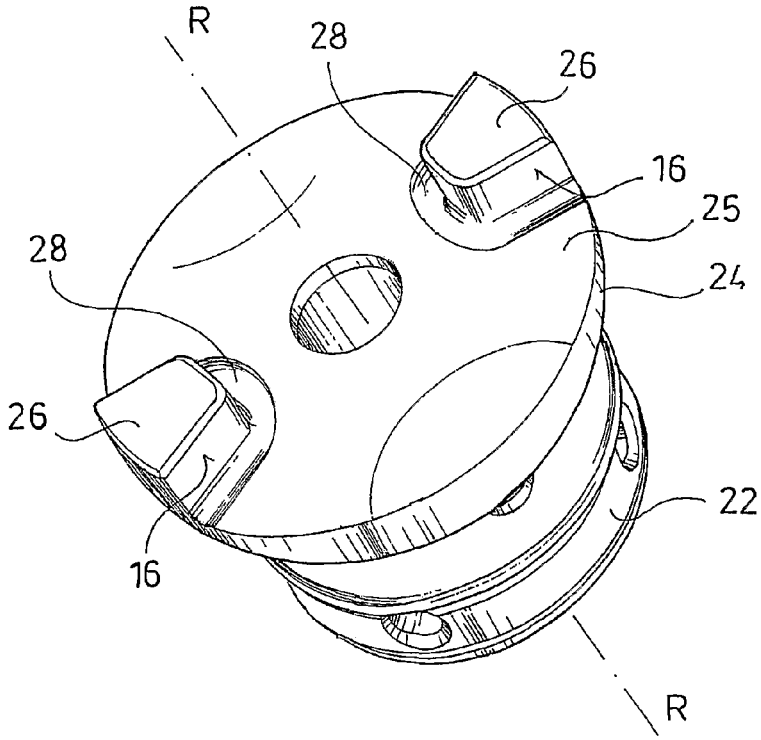
FIG. 4 is a perspective view of a hammer of the impact mechanism according to an embodiment of the invention.

With reference to FIGS. 4 and 5, the anvil 8 comprises a preferably annular or tubular middle portion 13, at least one abutment portion 14 radially protruding therefrom, which forms at least one abutment surface 15. The hammer 4 comprises at least one impact surface 16 and is suitable to give rotational pulses to the anvil 8 by the impact surface 16 hitting the abutment surface 15.

The abutment portion 14 and the middle portion 13 of the anvil 8 are connected by means of a first connection area 17 at least partially extending within the axial extension of the abutment surface 15 and middle portion 13 and, advantageously, the hammer 8 further comprises a reinforcement rib 18 being axially arranged out of the abutment surfaces 15 connecting the abutment portion 14 with the middle portion 13, thereby forming a second connection area.

With two connection areas being arranged and positioned between the abutment portion and the middle portion of the anvil, this abutment portion can be shaped, and consequently the abutment surfaces can be arranged and oriented, in an advantageous manner for the transmission of the screwing torque through torsional blows without tied to the need of restricting the bending moment (i.e. the radial extension of the abutment portion) and the stress average value (that is inversely proportional to the section area of the first connection area) in the first connection area.

Besides allowing to increase the absolute value of the impact force, the provision of the two connection areas also allows to develop and use new and advantageous solutions concerning the shape and positioning of the abutment surfaces of the anvil, which are suitable to permit a more effective screwing torque transmission, without increasing the risk that phenomena of fatigue and breaking of the anvil may occur in said first connection area.

In accordance with the embodiment shown for example in FIG. 5, the anvil 8 comprises two abutment portions 14 that are arranged radially opposite relative to the rotation axis R.

The reinforcement rib 18 is substantially flat and plate-like and preferably it lies on a plane perpendicular to the rotation axis R. This implies that the reinforcement rib is mainly stressed by tensions with directions included within the plane of the rib, thereby it can be made thinner.

In fact, in accordance with an embodiment of the invention, the reinforcement rib 18 has a lower thickness of the axial extension of the abutment surfaces 15 and/or axial thickness of the first connection area 17 relative to the rotation axis R. Whereby, the size and additional weight of the reinforcement rib can be reduced.

Furthermore, it has been demonstrated that by specifically selecting of the rigidity ratios of the first connection area (section area) and the reinforcement rib (thickness and radial and circumferential extension) as well as the radial extension of the abutment surfaces, the polar inertia of the anvil, can be reduced, at the same maximum transmissible torque, considering both the ultimate strength and the fatigue strength of the anvil. This reduction in the polar, i.e. rotational inertia, of the anvil is desired, since it allows the "clean" transmission of the torsional blows from the hammer to the screw or nut without first having to overcome a high inertia of the anvil.

To the purpose, it is advantageous that the thickness of the reinforcement rib is selected such as to range between 0.4 and 0.6 times, preferably about 0.5 times the axial extension of the abutment surfaces 15 and, preferably, also of the thickness of the first connection area 17.

Figure 7:
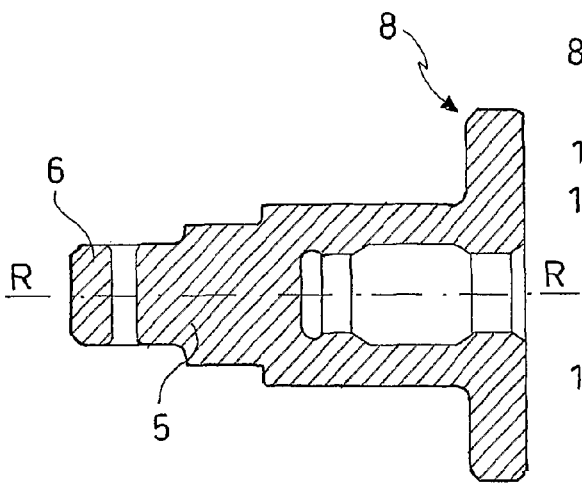
FIG. 7 is a longitudinal sectional view of the anvil from FIG. 5.

In accordance with a particularly advantageous embodiment, the first connection area 17 has an axial thickness that is substantially equal to the axial extension of the abutment surfaces 15 (FIGS. 5 and 7).

The reinforcement rib 18 has a greater circumferential extension than the angular extension a of each of the abutment portions 14 and extends, advantageously substantially to the radially outer surface of the abutment portion 14.

Figure 6:
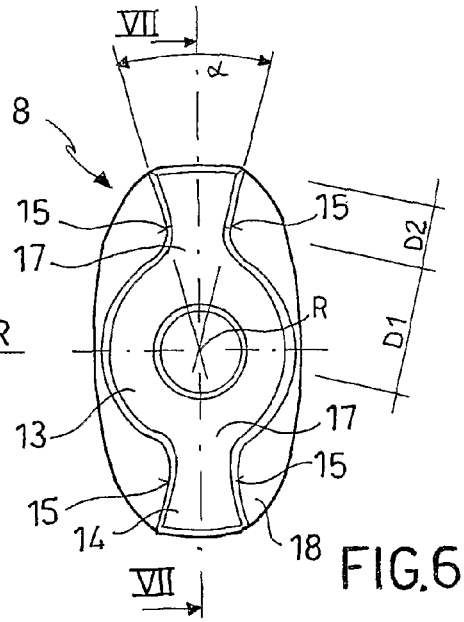
FIG. 6 is a front view of the anvil from FIG. 5.

In accordance with an embodiment, in the areas remote from the abutment portions 14, the radial extension of the reinforcement rib 18 is lower than its radial extension in those areas proximate to the abutment portions 14. Preferably, the reinforcement rib 18 is at least approximately oval, as may be seen for example in FIG. 6. Advantageously, in the areas remote from the abutment portions 14, the radial extension of the reinforcement rib 18 is substantially, or at least almost zero. This contributes to a further reduction both in the mass and the polar inertia of the anvil.

In accordance with a further embodiment, at the abutment portion/s 14, the reinforcement rib 18 has a radially outer area that is made lighter or tapered 19 such that the rotational inertia of the anvil 8 is further reduced.

A further aspect of the present invention relates to the shape and position of the abutment surfaces of the anvil and the abutment surfaces of the hammer allowing to increase the transmissible screwing torque, at the same weight and duration of the impact mechanism, until values that would cause the premature breaking of the hammer in the known impact mechanisms are reached and exceeded.

Those skilled in the art will easily appreciate how the shape and arrangement of the abutment surfaces are, on the one hand, inventions independent from that described so far and, on the other hand, surprisingly synergic with the latter.

In fact, while each of the individual inventions described herein solves, alone and individually, various problems connected with strength, size and screwing torque of an impact wrench, an unusual increase of at least 20% in the screwing torque can be obtained by combining the inventions, all said other parameters in the field of railway laying being equal.

By means of the anvil described so far, an increase in the screwing torque can be obtained compared with the prior art. However, this increase in the torque is limited. When a certain threshold value is reached (again, at the same weight, size and vibration control of the impact wrench), there occurs a fast reduction in the life of the hammer.

It has been found that the breakings occurring at the impact portions of the known hammer (FIG. 2) are due to radial stress components occurring while the hammer hits the anvil, and are neutralized due to the radial contrast provided by the impact portions of the hammer. It is assumed that the combined action of the stress in the tangent direction and in the radial direction reduces the break and fatigue strengths of the impact portions of the known hammer.

In order to eliminate said radial stress components, an embodiment of the present invention provides that the abutment surfaces 15 of the anvil and the impact surfaces 16 of the hammer are radial relative to the rotation axis R, plane and complementary to each other.

By means of the at least approximately radial and preferably perfectly radial arrangement of the surfaces involved in the impact, the mechanical strength of the hammer 4 can be increased.

Advantageously, each abutment portion 14 of the anvil comprises two abutment surfaces 15 opposite to each other, which define an angular extension of the abutment portion 14 relative to the rotation axis R equal to 20°-40°, preferably 25°-35°, still more preferably 30°. This provides the hammer with a sufficiently long path to accumulate a sufficient moment of the motion amount before engaging again with the anvil and such that the hammer and the anvil are completely engaged upon impact, despite the enlargement of the abutment portions resulting from the radial orientation of the abutment surfaces.

According to a further embodiment, the radial distance D1 between the rotation axis R and the abutment surface/s 15 is greater than the radial extension D2 of said abutment surface/s 15. Advantageously, the ratio (D1/D2 ratio) of the radial distance D1 between the rotation axis R and the abutment surfaces 15 and the radial extension D2 of said abutment surface/s 15 is selected in the range between 1.67 and 2.5. Preferably, this ratio (D1/D2 ratio) is 2.09. Due to said ratio of the distance to the radial extension of the abutment surfaces 15, at the same radial size of the anvil, an average value and an even distribution of the impact stress are obtained such that the maximum screwing torque can be transmitted without the life of the anvil and hammer being shortened.

The hammer 4 comprises a base body 21 with a rear portion 22 suitable to provide the connection with the reduction mechanism 3 and a front portion 24 suitable to engage the anvil 8.

The rear portion 22 is tubular, preferably cylindrical, and is intended to provide the connection of the hammer with the drive shaft 11 of the reduction mechanism 3. To the purpose, the rear portion 22 internally defines a seat 23 for the cam track 9 and the spring 20 or, alternatively, the cam track 9 and the spring 20 is directly formed within said rear portion 22. The seat 23 for the spring 20 is arranged radially outward of a tubular member, radially inward of the drive shaft 11 and radially inward of the impact relief 26.

The front portion 24 comprises a base plate 25, at least one impact relief 26 forming the impact surface/s 16 protruding therefrom in the axial direction. The plate 25 is substantially flat and perpendicular to the rotation axis R and is connected, by means of a connecting portion 26, to the rear portion 22 of the hammer.

According to an embodiment, the hammer 4 comprises two impact relieves 26 that are arranged radially opposed relative to the rotation axis R. Each impact relief 26 comprises two opposing, advantageously radial impact surfaces 16 defining a 20°-40°, preferably 25°-35°, still more preferably 30° angular extension β of the impact relief 26 relative to the rotation axis R.

Similarly to what has been described for the anvil, the radial distance D3 between the rotation axis R and the impact surface/s 16 is greater than the radial extension D4 of said impact surface/s 16. The ratio (D3/D4 ratio) of the radial distance D3 of the rotation axis R and the impact surface/s 16 to the radial extension D4 of the impact surface/s 16 is advantageously selected between 1.67-2.5 with 2.17 being preferred.

According to an embodiment, the front portion 24 of the hammer has a radial extension or diameter D5 greater than the radial extension or the diameter D6 of the rear portion 22. Whereby, the polar inertia of the hammer can be concentrated in the impact area and the hammer size can be reduced in the interaction area with the disengaging mechanism, thus creating further space for connecting the cam 9 to the hammer, for example by means of screws 29 or pins.

Said diameter variation is achieved by means of the connecting portion 27 radially widening towards the front portion 24.

Figure 9:
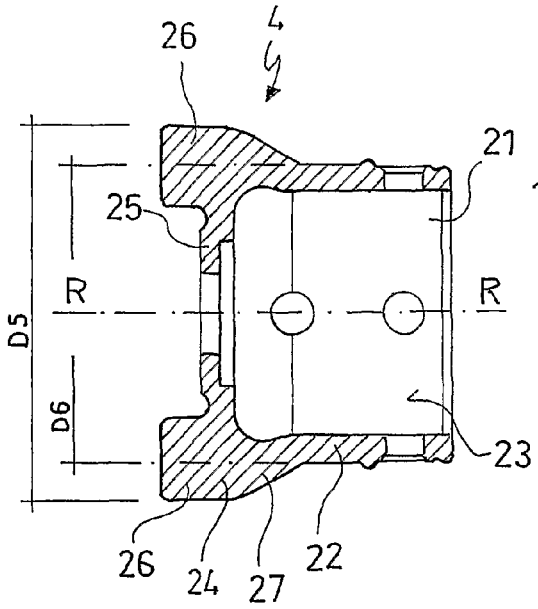
FIG. 9 is a longitudinal sectional view of the hammer from FIG. 4.
Figure 8:
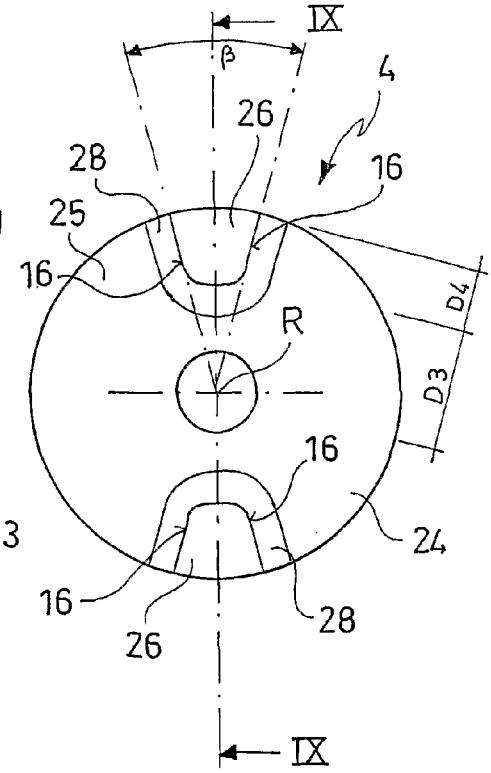
FIG. 8 is a front view of the hammer from FIG. 4.

According to a further advantageous aspect of the present invention, the connecting portion 27 has an overall substantially tubular shape, either of a truncated cone or bell-like (FIG. 9), the wall thickness thereof increasing towards the front portion 24. Due to the particular shape of the connecting portion 27, the polar inertia moment of the hammer can be increased in the impact area, the mass thereof being reduced compared with the prior art solutions.

Advantageously, the maximum radial wall thickness of the connecting portion 27 is substantially the same as the radial extension of the impact relieves 26 such that the direct transmission of the impact stress from the impact relieves in the connecting portion is facilitated.

As it may be seen in FIG. 7, the impact relieves are arranged at the wall of the connecting portion.

In accordance with a further embodiment, said base plate 25 is arranged such as to connect diametrically opposing areas of the front portion 24 of the hammer for the latter to be reinforced and stiffened in a plane perpendicular to the rotation axis R and in order to avoid deformations, particularly "ovalizations" that may otherwise cause the breaking of the hammer.

Advantageously, the base plate 25 has the shape of an annular disc with a radial thickness preferably greater than the radial extension of the impact surfaces 16.

In order to facilitate a "shear wall"-type structural behaviour of the base plate, this is made with a lower axial thickness than the radial wall thickness of the connecting portion 27, particularly in the vicinity of the base plate 25. This reduction in the thickness of the base plate compared with the known solutions allows for a further mass reduction in the radially inner areas, i.e. those areas where the hammer mass does not substantially contribute to the inertia polar moment.

Advantageously, the axial thickness of the base plate 25 is also lower than or equal to the axial extension of the impact surfaces 16 and accordingly the impact relieves 26, with the result that they transmit the impact force, i.e. the torsional moment, directly in the connecting portion, due to the connecting portion, base plate and impact relieves stiffness ratios, and the base plate stabilizes the circular shape of the connecting portion, thereby avoiding the "ovalization" of the same.

In accordance with the preferred embodiment, in order to reduce strain concentrations in the impact relieves, there are further provided one or more strain relief gorges extending at the respective impact relief 26. Advantageously, each impact relief comprises such a strain relief gorge 28 at least partially extending about the root of the impact relief.

The invention claimed is:

1. An impact mechanism (12) for an impact wrench (1), said impact mechanism (12) comprising:

an anvil (8) rotatable about a rotation axis (R) and provided with a middle portion (13), at least one abutment portion (14) radially protruding therefrom, which forms at least one abutment surface (15); and a hammer (4) rotatable about the rotation axis (R) comprising a rear portion (22) suitable to provide a connection with a drive shaft (11) of a reduction mechanism (3) and a front portion (24) forming at least one impact relief (26) forming at least one impact surface (16), the front portion (24) comprising a base plate (25) having a shape of an annular disc and connecting diametrically opposing areas of the front portion (24) thereby stiffening the front portion (24) in a plane perpendicular to the rotation axis (R), and the front portion (24) with the impact relief (26) and the rear portion (22) being formed integrally, wherein the base plate (25) extends radially inside the hammer (4) and is disposed radially inward of said at least one impact relief (26) and forms an internal abutment surface for a spring (20) of a hammer engaging mechanism, said internal abutment surface for said spring (20) being formed inside the hammer (4), and wherein a seat for said spring (20) is arranged radially outward of a tubular member, radially inward of the drive shaft (11) and radially inward of said impact relief (26), wherein the hammer (4) is suitable to give rotational pulses to the anvil (8) by the impact surface (16) hitting the abutment surface (15), wherein the anvil (8) comprises a first connection area (17) connecting the abutment portion (14) to the middle portion (13), said first connection area (17) at least partially extending within the axial extension of the abutment surface (15) and the middle portion (13), wherein the anvil (8) comprises a reinforcement rib (18) being axially arranged out of the abutment surface (15), which connects the abutment portion (14) to the middle portion (13) of the anvil (8), thereby forming a second connection area.

2. The impact mechanism (12) according to claim 1, wherein the anvil (8) comprises two abutment portions (14) that are arranged radially opposite relative to the rotation axis (R).

3. The impact mechanism (12) according to claim 1, wherein the reinforcement rib (18) has a greater circumferential extension, relative to the rotation axis (R), than the angular extension ($\alpha$) of the abutment portion (14) or abutment portions (14).

4. The impact mechanism (12) according to claim 1, wherein the reinforcement rib (18) substantially extends to the radially outer end of the abutment portion (14) or abutment portions (14).

5. The impact mechanism (12) according to claim 1, wherein, in the areas remote from the abutment portions (14), the radial extension of the reinforcement rib (18) is lower than its radial extension in the areas near the abutment portions (14).

6. The impact mechanism (12) according to claim 1, wherein the reinforcement rib (18) is substantially flat and plate-like.

7. The impact mechanism (12) according to claim 1, wherein the reinforcement rib (18) lies in a plane perpendicular to the rotation axis (R).

8. The impact mechanism (12) according to claim 1, wherein the reinforcement rib (18) is approximately oval.

9. The impact mechanism (12) according to claim 1, wherein the abutment surfaces (15) are radial relative to the rotation axis (R).

10. The impact mechanism (12) according to claim 1, wherein each abutment portion (14) comprises two impact surfaces (16) opposite to each other, which define the angular extension ($\alpha$) of the abutment portion (14), relative to the rotation axis (R), wherein the angular extension ($\alpha$) is 20°-40°.

11. The impact mechanism (12) according to claim 10, wherein the abutment portion (14) has a 25°-35° angular extension ($\alpha$).

12. The impact mechanism (12) according to claim 11, wherein the abutment portion (14) has an angular extension ($\alpha$) of 30°.

13. The impact mechanism (12) according to claim 1, wherein the reinforcement rib (18) has a lower thickness of the axial extension of the abutment surfaces (15) relative to rotation axis (R).

14. The impact mechanism (12) according to claim 1, wherein the thickness of the reinforcement rib (18) is selected in the range between 0.4 and 0.6 times the axial extension of the abutment surfaces (15) relative to the rotation axis (R).

15. The impact mechanism (12) according to claim 1, wherein the thickness of the reinforcement rib (18) is equal to 0.5 times the axial extension of the abutment surfaces (15) relative to the rotation axis (R).

16. The impact mechanism (12) according to claim 1, wherein the reinforcement rib (18) has a lower thickness of the axial thickness (17) of the first connection area (17) relative to the rotation axis (R).

17. The impact mechanism (12) according to claim 1, wherein the reinforcement rib (18) has a tapered or weight relieved radially outer area (19) near the abutment portion(s) (14).

18. The impact mechanism (12) according to claim 1, wherein the first connection area (17) substantially has the same axial thickness as the axial extension of the abutment surfaces (15).

19. The impact mechanism (12) according to claim 1, wherein the radial distance (D1) between the rotation axis (R)

and the abutment surface/s is greater than the radial extension (D2) of said abutment surface(s) (15).

20. The impact mechanism (12) according to claim 1, wherein the ratio (D1/D2 ratio) of the radial distance (D1) between the rotation axis (R) and the abutment surface/s (15) to the radial extension (D2) of said abutment surface(s) (15) is selected in the range between 1.67 and 2.5.

21. The impact mechanism (12) according to claim 20, wherein said ratio (D1/D2 ratio) is about 2.09.

22. The impact mechanism (12) according to claim 1, wherein the hammer (4) comprises two impact relieves (26) that are arranged radially opposite relative to the rotation axis (R).

23. The impact mechanism (12) according to claim 1, wherein the abutment surfaces (16) are radial relative to the rotation axis (R).

24. The impact mechanism (12) according to claim 1, wherein each impact relief (26) comprises two impact surfaces (16) opposite to each other, defining a 20°-40° angular extension β of the impact relief (26) relative to the rotation axis (R).

25. The impact mechanism (12) according to claim 1, wherein the impact relief (26) has 25°-35° angular extension β.

26. The impact mechanism (12) according to claim 1, wherein the impact relief (26) has 30° angular extension β.

27. The impact mechanism (12) according to claim 1, wherein the radial distance (D3) between the rotation axis (R) and the abutment surface/s (16) is greater than the radial extension (D4) of said abutment surface(s) (16).

28. The impact mechanism (12) according to claim 1, wherein the ratio (D3/D4 ratio) of the radial distance (D3) between the rotation axis (R) and the abutment surface/s (16) to the radial extension (D4) of said abutment surface(s) (16) is selected in the range between 1.67 and 2.5.

29. The impact mechanism (12) according to claim 28, wherein said ratio (D3/D4 ratio) is about 2.17.

30. The impact mechanism (12) according to claim 1, wherein the front portion (24) is suitable to engage the anvil (8) for the latter to be rotatably driven, and the front portion (24) has a greater radial extension or diameter (D5) than the radial extension or diameter (D6) of the rear portion (22).

31. The impact mechanism (12) according to claim 1, wherein the rear portion (22) and the front portion (24) are connected by means of a connecting portion (27) that radially widens towards the front portion (24).

32. The impact mechanism (12) according to claim 1, wherein the connecting portion (27) has an overall substantially tubular shape, either of a truncated cone or bell-like shape, the wall thickness thereof increasing towards the front portion (24).

33. The impact mechanism (12) according to claim 31, wherein the maximum radial wall thickness of the connecting portion (27) is substantially equal to the radial extension (D4) of the impact relieves (26).

34. The impact mechanism (12) according to claim 31, wherein the impact relief (26) protrudes from the base plate (25) in the axial direction.

35. The impact mechanism (12) according to claim 34, wherein the axial thickness of the base plate (25) is lower than the radial wall thickness of the connecting portion (27) at the base plate (25).

36. The impact mechanism (12) according to claim 34, wherein the axial thickness of the base plate (25) is lower than or equal to the axial extension of the impact surfaces (16).

37. The impact mechanism (12) according to claim 1, wherein the hammer (4) comprises a strain relief groove (28) extending at the impact relief/relieves (26).

38. An impact wrench (1) comprising an impact mechanism (12) according to claim 1.

39. The impact mechanism (12) according to claim 1, wherein said spring (20) provides a contact force between a disengaging mechanism and at least one revolving element.

* * * * *